US011611818B1

(12) United States Patent
Miller et al.

(10) Patent No.: US 11,611,818 B1
(45) Date of Patent: Mar. 21, 2023

(54) METALLIC AUDIO SPEAKER COVER WITH A MULTI-COLOR CLOTH-LIKE APPEARANCE AND METHOD OF MANUFACTURING

(71) Applicant: OAKWOOD METAL FABRICATING CO., Dearborn, MI (US)

(72) Inventors: William Todd Miller, Allen Park, MI (US); Michael Allen Johnson, Farmington Hills, MI (US); Robert Arthur Sonnenberg, Novi, MI (US); Joel Matthew Cormier, Lathrup Village, MI (US); Richard Francois Audi, Dearborn, MI (US); Donald Scott Smith, Commerce, MI (US)

(73) Assignee: OAKWOOD METAL FABRICATING CO., Dearborn, MI (US)

( * ) Notice: Subject to any disclaimer, the term of this patent is extended or adjusted under 35 U.S.C. 154(b) by 0 days.

(21) Appl. No.: 17/459,390

(22) Filed: Aug. 27, 2021

(51) Int. Cl.
*H04R 25/00* (2006.01)
*H04R 1/02* (2006.01)

(52) U.S. Cl.
CPC ..... *H04R 1/023* (2013.01); *H04R 2201/029* (2013.01)

(58) Field of Classification Search
CPC ..... H04R 19/04; H04R 1/04; H04R 1/222; H04R 19/005; H04R 2201/003
See application file for complete search history.

(56) References Cited

U.S. PATENT DOCUMENTS

| | | | | |
|---|---|---|---|---|
| 6,279,678 | B1 * | 8/2001 | Tracy | H04R 1/02 181/144 |
| 9,014,411 | B2 | 4/2015 | Rodgers | |
| 10,135,130 | B1 * | 11/2018 | Bouchard | H01Q 1/245 |
| 10,253,807 | B2 | 4/2019 | Heldmann et al. | |
| 11,011,168 | B2 | 5/2021 | Heckmann et al. | |
| 2020/0384734 | A1 * | 12/2020 | Akisada | B32B 27/302 |
| 2021/0085047 | A1 * | 3/2021 | Wright | A45C 13/02 |

FOREIGN PATENT DOCUMENTS

| | | |
|---|---|---|
| CN | 210547380 U | 5/2020 |
| EP | 3846494 | 7/2021 |
| JP | 2019514252 | 5/2019 |
| KR | 20030087100 | 11/2003 |
| KR | 101242922 | 3/2013 |

* cited by examiner

*Primary Examiner* — Amir H Etesam
(74) *Attorney, Agent, or Firm* — Brooks Kushman P.C.

(57) ABSTRACT

A metallic audio speaker cover and a related method of manufacturing that has a surface with a cloth-like appearance. The metallic audio speaker cover has a base of expanded metal through which sound may pass; a pretreatment film which adheres to the expanded metal base; and one or more multi-color powder coating films that adhere to the pretreatment film. In some embodiments, the surface also has anti-microbial properties.

12 Claims, 4 Drawing Sheets

METALLIC AUDIO SPEAKER COVER WITH A MULTI-COLOR CLOTH-LIKE APPEARANCE AND METHOD OF MANUFACTURING

TECHNICAL FIELD

Several aspects of this disclosure relate to metallic audio speaker covers with a multi-color, cloth-like appearance and methods of manufacturing such products.

BACKGROUND ART

As a general rule, the audio speaker covers must be an integral part of the automotive interior design theme. The materials of which such covers are made are in close proximity to each other and the interior design theme includes leather, fabrics, hard and soft plastic trim, plastic trim covered in fabric, and various metal components with which the audio speaker cover must be in visual harmony.

Traditionally, the finishes on the metal audio covers have been selected such that they present a notable contrast in finish and texture compared to the remainder of the cabin. Historically, the OEM would choose a single material/color/tone/finish for the audio cover so that this audio cover contrasted with the rest of the interior. This theme was typically deployed to highlight branded premium audio packages and systems.

Recently, with the transition to electric propulsion for the automotive industry, there has been an initiative to reduce weight and streamline interior componentry. This paradigm shift now more often requires that metal audio covers essentially mimic the gloss, texture, and color of adjacent fabric or other material patterns to create a harmonious styling theme.

Metallic audio speaker covers have been historically produced from a variety of metals. These include alloys of low carbon steel, aluminum, stainless steel, and other cost-effective metals with a high strength-to-weight ratio. Based on the unique physical characteristics of each metal and alloy, the base material thickness of the audio cover is typically selected such that there is adequate strength after the open area has been created for sound transmission, to withstand wear and tear during manufacturing and after the intermediate product has been converted into a finished audio cover.

Various methods are available to generate open areas in the speaker grille for sound transmission. These include punch perforating, laser perforating, water jet cutting, drilling, photo chemical etching, and metal expanding, among others. Each method for generating the open area creates a unique metallic surface "texture", ranging from relatively smooth to coarse/undulating. Depending upon which method is chosen, creating an open area for sound transmission can be accomplished in an individual metal blank or while the metal is still in coil form. Creating the open area in coils typically offers superior economics and throughput. Once the open area has been generated, coils or blanks of material are converted into formed metallic covers using traditional metal forming processes, including blanking, punching, forming, cam-forming, and the like.

Optionally, a pretreatment may be considered to cleanse the cover before subsequent coatings or to prevent oxidation of the metal before final finishing. These pre-treatments can range from merely surface cleaning to chemically etching, where metal is removed, to applying a physical layer including primers, zinc phosphate, iron phosphate, galvanizing, e-coatings and the like.

Finishing techniques for metallic audio covers have traditionally involved single color or tinted coatings. Finishing techniques for single color coatings include thermosetting powder coatings, solvent-based lacquers and enamels, water-based paints, color anodizing layers, material PVD (physical vapor deposition), tinted clear coats, and the like.

Wet spray painting involves solvent-based paint systems. These include lacquer and enamel. They have been historically applied via a spray gun to a variety of metal components, including audio covers. These coatings may be clear, opaque, or solid in color. Other solid elements can be added to these coatings to add depth of color including pearl, metallic, and other solid particles. Due to environmental concerns, this type of coating is only used when a perfectly smooth surface is required. The wet spray process cannot provide a multi-color surface that simulates a cloth-like appearance on metallic audio covers.

Metal anodizing imparts a tinted coating to a metal surface. Metallic parts are dipped into a single color chemistry that creates an anodic layer of coating on the part surface. Like wet spray painting approaches, conventional anodizing processes cannot produce a multi-color surface that simulates a cloth-like appearance on metallic audio covers.

Traditional PVD techniques involve a single solid color/tone material that is vaporized in a vacuum and deposited on the surface of metallic audio cover within a chamber.

Like the other techniques referenced above, the PVD process cannot provide a multi-color surface that simulates a cloth-like appearance on metallic audio covers.

Conventional powder coated audio covers typically produce a single monolithic color. Such techniques cannot provide a multi-color surface that simulates a cloth-like appearance on metallic audio covers.

The prior art discussed above represents conventional methods for generating single color/tone appearances on metal speaker covers. These traditional finishes are deficient in their ability to simulate the color and texture of multi-color fabrics. Specifically, the surface appearance of automobile speaker grilles made by conventional techniques lacks one or more steps necessary to simulate the appearance of multi-color fabrics. What is desired is an audio speaker grille that resembles a cloth or fabric in terms of color, gloss, surface topography and other performance requirements.

Prior art processes only produce a single color coating that does not mimic a cloth-like appearance. What the industry desires is a metal audio cover that has superior acoustics and durability that metal audio covers provide, while at the same time having the look of a cloth or fabric and having anti-microbial properties.

SUMMARY

Several aspects of this disclosure relate to a product and methods for manufacturing metal audio component or speaker covers with a multi-color, cloth-like appearance. Specifically, the techniques disclosed balance the primary elements necessary to simulate the appearance of multi-color fabrics within a metallic audio cover.

Various process steps include combinations of multi-color coatings, low gloss, and metallic patterns with adequate surface area and surface topography to match those of a target fabric. Suitable combinations achieve the goal of a metallic audio cover that offers superior acoustic properties and the durability that metal audio covers provide with a surface that looks like a fabric.

Of related importance is the ability to provide an anti-microbial finish to these metal audio covers in the painting process. Along with the inherent disadvantages of cloth speaker covers that include staining and tearing, anti-microbial properties assume significance in the context of current and future health concerns.

In a preferred set of process steps, one first selects a traditional or non-traditional expanded metal pattern and attempts to match the surface texture of a target fabric. In addition to the pattern of the metal itself, one must also consider the film build of both the pretreatment (if applicable) and the film build of the multi-color coating. The combination of pattern and layered film build desirably mimics the target fabric. Additionally, the final finish coating preferably exhibits a gloss level that which closely matches that of the target fabric.

The above advantages and other advantages and features of the present disclosure will be readily apparent from the following detailed description of the preferred embodiments and process steps when taken in connection with the accompanying drawings.

DETAILED DESCRIPTION

As those of ordinary skill will understand, various features of the present disclosure as illustrated and described with reference to any one of the Figures may be combined with features illustrated in one or more other Figures to produce embodiments of the present disclosure that are not explicitly illustrated or described. The combinations of features illustrated provide representative embodiments for typical applications. However, various combinations and modifications of the features consistent with the teachings of the present disclosure may be desired for particular applications or implementations.

Figure 1:
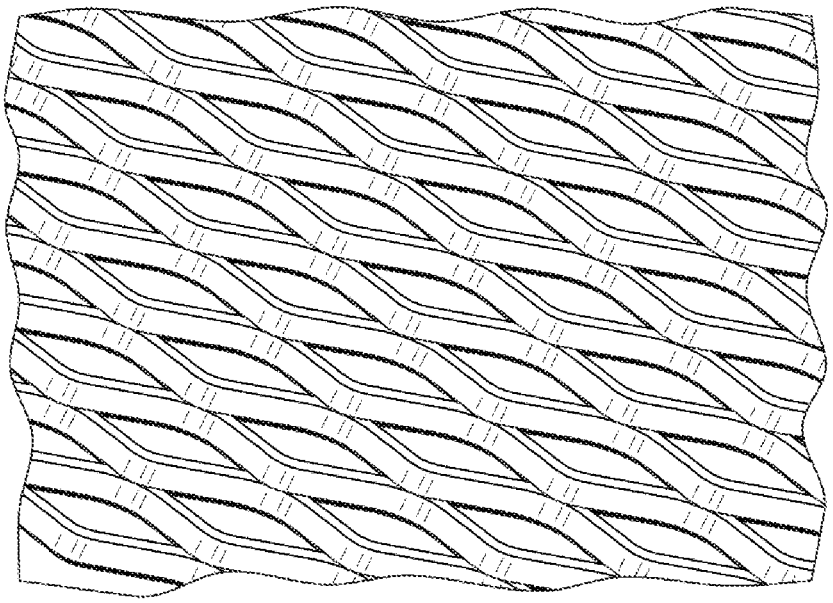
FIG. 1 is a perspective view of a representative specimen of expanded metal before being subjected to subsequent processing steps.

In a preferred series of process steps, one process begins with the selection of an expanded metal pattern. FIG. 1 is an image of traditional raw expanded metal before exposure to subsequent handling. During metal expanding, an expanding tool imparts a pattern into a continuous coil of a malleable alloy of for example low carbon steel or aluminum using a bypass shearing process. Some pattern design elements to be selected include a type or gauge of expanding tool, material thickness, material type and expanded metal machine process variables/settings such as those shown in FIG. 2.

Figure 2:
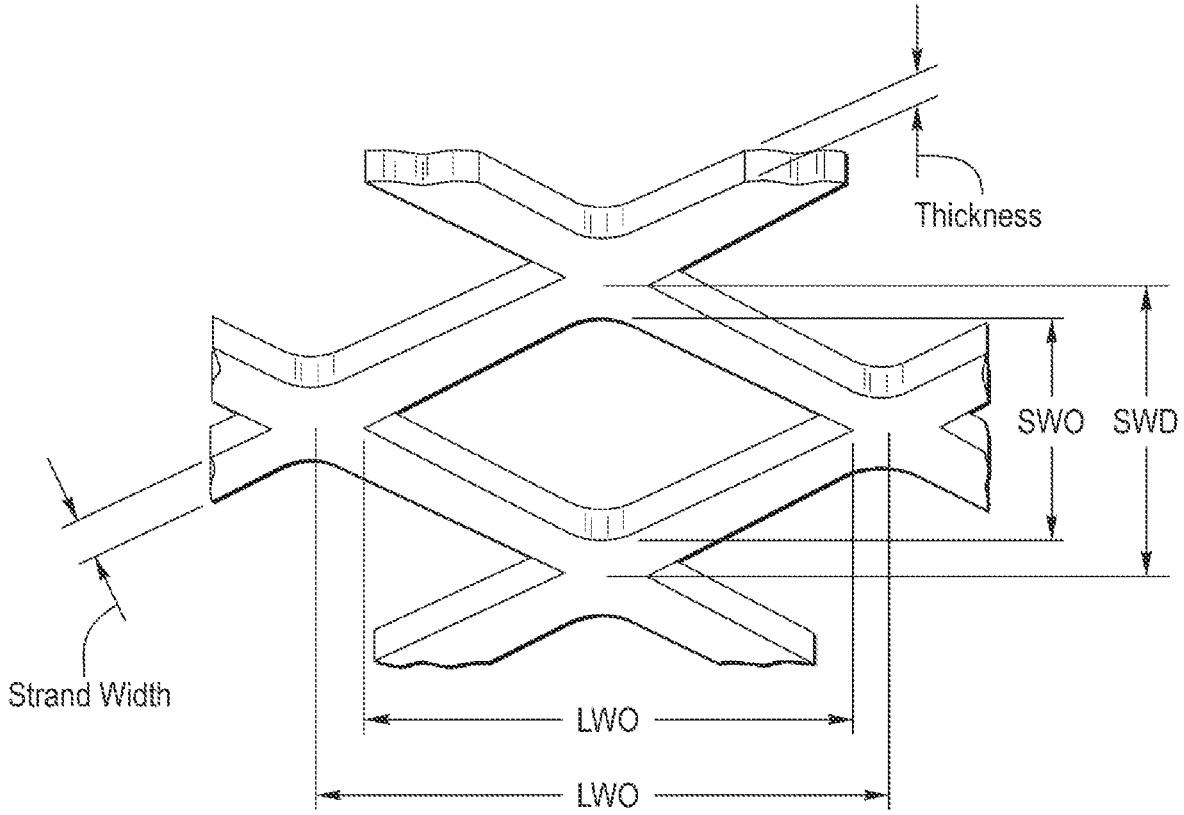
FIG. 2 is an expanded view of a specimen of expanded metal that depicts some of its identifying characteristics.

Traditional expanded metal patterns are created using a contoured shearing blade with a sawtooth pattern having a flattened "saw tip". The period between teeth and the shape of each tooth are some of the factors which influence a pattern that matches the surface topography of a target fabric. Changing these factors influences the expanded pattern imparted into the metal. Referring to FIG. 2, representative elements of a 2D/3D surface which matches that of the target fabric include the SWD (short way of diamond) and LWD (long way of diamond), as well as SWO (short way of opening) and LWO (long way of opening), ST (strand thickness) and SW (strand width).

One goal of the disclosed process is to produce a cloth-like metallic audio speaker that has the appearance of a fabric, i.e., the property of a fabric that directly strikes the observer's eye. That property is related to the surface of the fabric. The fabric appearance is directly associated with the fabric construction, weave, degree of twist, the material used, and reflectance properties of the material. www.textileadvisor.com/2019/02/fabric-appearance-fabric-properties-of.html.

The interior fabric materials that are of interest are generally multi-colored, woven fabrics with a relatively low gloss. There are many woven patterns. Generally, these patterns are relatively fine, such that the substrate that they overlie is not visible. Illustrative examples are depicted at www.midwestfabrics.com/fabric/automotive-upholstery-fabric.html, which is incorporated by reference. That source suggests that automotive upholstery can be characterized by such factors as category (e.g., OEM Detroit Number), color (white, grey, black, red, beige, brown, blue, green, tan, purple and silver), fabric content (polyester, vinyl, fabric, nylon/polyester, and tweed), vehicle make, vehicle year and price. The source defines 218 items of automotive upholstery fabric.

Figure 3A:
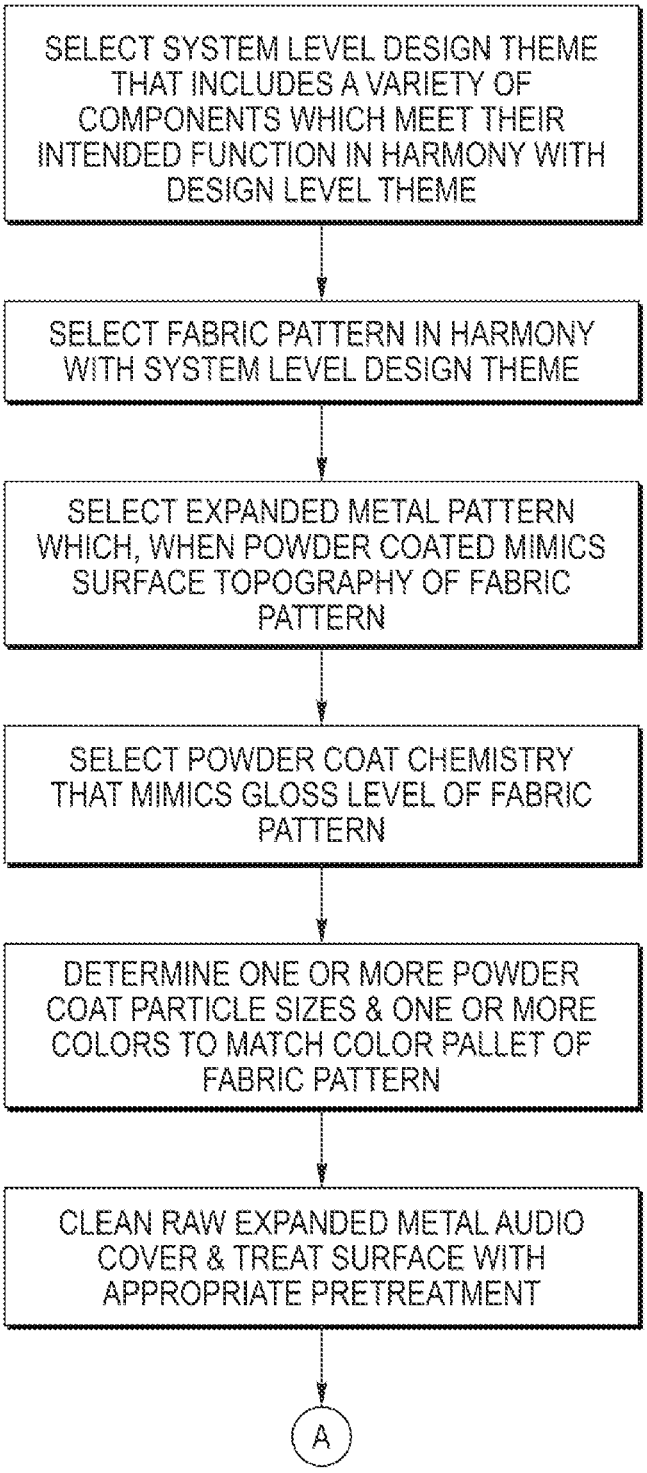
FIG. 3 is a representative process flow diagram.
Figure 3B:
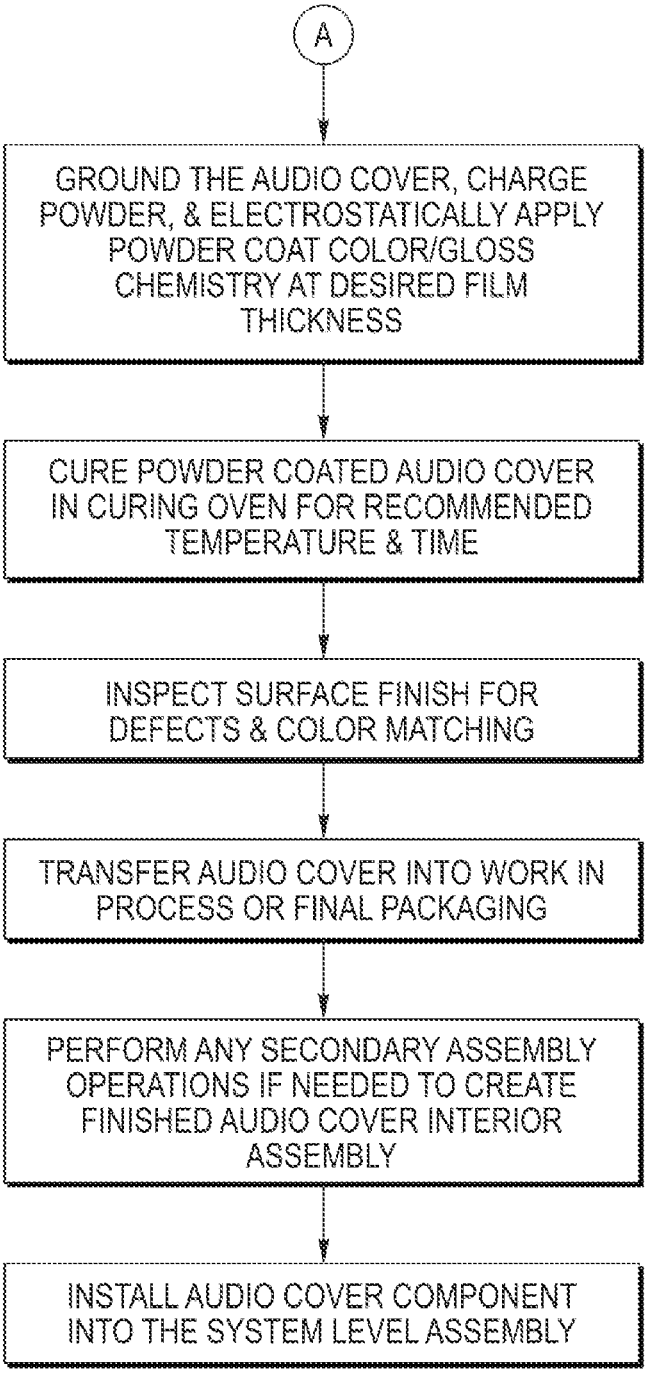
Figure 4:
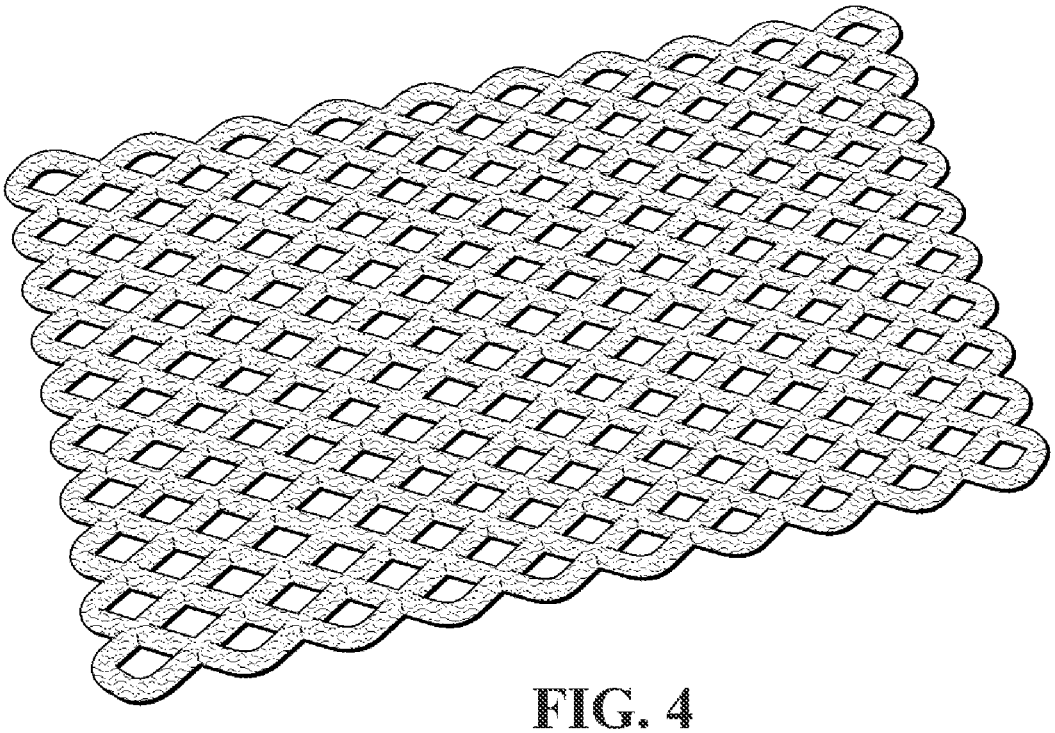
FIG. 4 is a quartering perspective enlarged top view of an area of a cloth-like multi-color expanded metal audio speaker cover.

FIG. 3 is a process flow diagram that details representative steps for configuring an audio cover with a cloth-like appearance.

Powder coat chemistry, powder color pallet, powder particle size, and the additives used to control gloss are factors that influence a cloth-like appearance. In the preferred embodiment, a specific polyester (TGIC—triglycidyl isocyanurate—a chemical compound formulated in some powder coatings as a curing agent) or polyester urethane chemistries are utilized. Such chemistries have demonstrated their ability to meet automotive performance specifications for interior trim.

Figure 5:
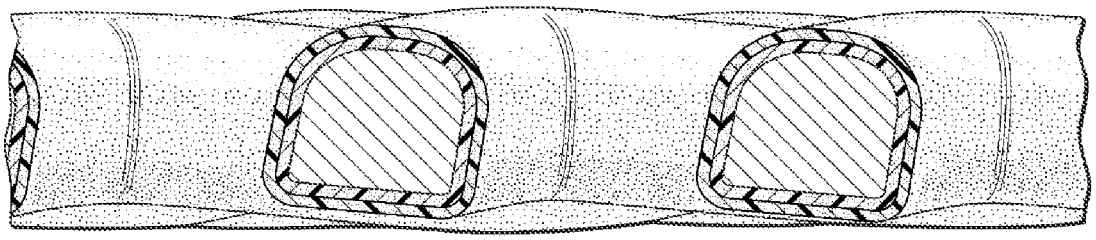
FIG. 5 is an enlarged sectional view through a specimen of expanded metal that is encapsulated by a primer film and a multi-color paint.

FIG. 5 depicts a representative cross-sectional view of a finished audio speaker grille. The grille has a substrate that is an expanded metal. On an upper surface of the expanded metal and at least partially permeating therethrough is a pretreatment film which supports a multi-color powder coating film. During the electrostatic powder coat painting process step, virtually all of the raw expanded metal surface area is encapsulated by the pre-treatment film layer. This pretreatment film layer is then preferably completely encapsulated by the multi-color powder coating film with clothlike appearance as described. The interior Class A surface is the surface of prime interest as it lies adjacent to the target fabric it seeks to mimic. By following the disclosed process steps, the surface A-A of the top side of the target fabric is mimicked by the surface B-B of the audio speaker grille. Sound passes through the open spaces formed through the expanded metal grille. The sectional view in FIG. 5 through the expanded metal pattern depict the layering described herein.

Master color panels are provided by the OEM to coordinate color matching and color harmony within a given interior trim system. Powder coating formulas are developed to match a base coat color. This color match is prepared to include a specific particle size distribution. Secondary color formulation follows the same initial color matching process;

however, the particle size distribution curve is changed to enhance a secondary color appearance on a metallic grille surface. A desired result is a metal speaker grille that looks like a cloth or fabric.

Details of representative powder coating process parameters and a powder coating troubleshooting guide can be found at www.tcipowder.com/resources/troubleshooting-guide/chapter-eleven-powder-curing-process, which is incorporated by reference.

The expanded metal is subjected to one or more pretreatment steps to enhance adhesion of powder to the expanded metal substrate. Suitable pretreatment enables lasting corrosion resistance to be achieved. Such pretreatment steps often include cleaning the substrate to remove for example contaminants and oils, rinsing, and chemically converting the cleaned and rinsed substrate surface. Such conversion may for example involve chromate conversion for aluminum and iron phosphate for ferrous metals.

Most conversion coatings include a film that changes the physical and chemical nature of the expanded metal surface. Often the film may exhibit a grey to blue iridescence or blue to gold iridescence.

Gloss is measured by shining a known amount of light at a surface and quantifying the reflectance. www.gloss-meters.com/GlossIntro2.html. Most automotive interior fabrics have relatively low gloss levels that typically range from 3-9% at a 60-degree viewing angle. In the preferred embodiment, the gloss levels of a finished cloth-like powder coated expanded metal audio cover that most closely matches the fabric system has a gloss level from 5-7% at a 60-degree viewing angle. Those skilled in the art will understand that gloss chemistry formulations and final gloss appearance can be adjusted upwardly or downwardly depending on the desired appearance of the finished audio cover. Process variables in making a cloth-like metallic speaker grill include surface texture, the number of powder particle colors, the sizes of the powder particles, the ratio of colors and particle sizes, and average gloss level.

One goal is to provide an accent that harmonizes with a given interior design theme. Desirably, one result is a soft cloth-like appearance that is created by a multi-colored, speckled appearance which imbues a perceived 2D/3D dimensionality that simulates a fabric. In contrast, conventional approaches produce a coating of a single color that does not resemble a cloth-like appearance.

In one approach, metallic audio covers are processed through an electrostatic powder coating system that applies the chemistry developed to match the color and gloss of the target fabric. This powder coat chemistry needs to be applied at the appropriate film build stage and subsequently cured, preferably using a two-stage curing system in a controlled manner. Such a controlled application and curing system have been found to provide a consistent color, a suitable gloss, a satisfactory appearance, and other performance characteristics. Such characteristics include resistance to various solvents, cleaners, salt spray, abrasion, scratch scuff, anti-microbial properties and mar resistance in addition to having a color and apparent texture that match a master sample. If desired, one or more films can be applied by a powder coating process.

As used herein, the term "anti-microbial" refers to a property or coating which contains an active ingredient that renders it effective against bacterial and fungal growth.

Antimicrobial coatings may include solvent, water-based, liquid, or powder coatings. See, e.g., www.microban.com/antimicrobial-solutions/applications/antimicrobial-paints. Suitable formulations can be obtained from such sources as Microban, www.microban.com. The anti-microbial agent may be added to one or more of the pre-treatment film and/or the multi-color powder coating film.

The methods described herein take the manufacture of enhanced audio covers to the next level in terms of texture and simulation of a cloth-like appearance using alternative coating techniques and chemistries. Such techniques produce audio coverings that provide the cloth-like finishes that match the styling theme.

At least some of the advantages of the disclosure process steps include:

Lower cost
Superior durability
No adhesives required (unlike fabric-covered grilles)
Convex and concave shapes are possible that cannot be embodied with fabric
Fewer components
Reduced system level complexity.

Testing has shown that a fabric-covered plastic audio cover and the disclosed powder coated audio cover with cloth-like appearance bear a close resemblance. An ordinary observer cannot readily distinguish one from the other as to surface color, appearance of the texture and gloss level.

While the best mode has been described in detail, those familiar with the art will recognize various alternative process steps, designs and embodiments lie within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A metallic audio speaker cover comprising a base of expanded metal; a pretreatment film that adheres to the expanded metal base; and a multi-color powder coating film that adheres to the pretreatment film, the multi-color powder coating having a surface that has a cloth-like appearance, wherein the multi-color powder coating film includes a coating formula developed to match a base coat color, the coating formula including an initial predetermined particle size distribution.

2. The metallic audio speaker cover of claim 1 wherein the multi-color powder coating film further includes one or more subsequent color formulations, each having a particle size distribution curve that differs from the initial predetermined particle size distribution to enhance a secondary or subsequent color appearance on a metallic grille surface.

3. The metallic audio speaker cover of claim 1 further having an outer surface that faces an observer, the outer surface being characterized by a gloss, texture and color that mimics corresponding properties of an adjacent fabric, the gloss having a gloss level from about 5-7% at a 60-degree viewing angle.

4. A method of manufacturing a metallic audio speaker cover, the method comprising the steps, not necessarily practiced in the order presented, of:

providing a base of expanded metal;

adhering a pretreatment film to the expanded metal base; and powder coating one or more multi-color films that adhere to the pretreatment film, the one or more multi-color powder films having a surface that has a cloth-like appearance, wherein the step of powder coating includes utilizing a coating formula that matches a base coat color and selecting an initial predetermined particle size distribution.

5. The method of claim 4 wherein the step of powder coating further includes utilizing one or more subsequent color formulations, each having a particle size distribution curve that differs from the initial predetermined particle size distribution to enhance a secondary or subsequent color appearance on a metallic grille surface.

6. The method of claim 5 wherein the step of powder coating further includes providing an outer surface that faces an observer, the outer surface being characterized by a gloss, texture and color that mimics corresponding properties of an adjacent fabric.

7. The metallic audio speaker cover of claim 1 wherein the base of expanded metal is characterized by such factors as a SWD (short way of diamond), a LWD (long way of diamond), a SWO (short way of opening) a LWO (long way of opening), a ST (strand thickness) and a SW (strand width).

8. The metallic audio speaker cover of claim 1 wherein the base of expanded metal includes a material selected from the group consisting of an alloy of low carbon steel, aluminum, an aluminum alloy, stainless steel, and combinations thereof.

9. The metallic audio speaker cover of claim 1 wherein the base of expanded metal includes openings that are devoid of the pretreatment film and the multi-color powder coating film to permit sound passage through the audio speaker cover.

10. The metallic audio speaker cover of claim 1 further including one or more antimicrobial agents.

11. The metallic audio speaker cover of claim 1 wherein the pretreatment film cleanses the expanded metal base before one or more subsequent coatings are applied and includes a physical layer with an ingredient selected from the group consisting of a primer, zinc phosphate, iron phosphate, a galvanic material, and an electro-coating.

12. The metallic audio speaker cover of claim 1 wherein the multi-color powder coating film has an outer surface that resembles an automotive fabric or cloth-like material.

* * * * *